US009172166B2

(12) United States Patent
Kida et al.

(10) Patent No.: US 9,172,166 B2
(45) Date of Patent: Oct. 27, 2015

(54) PRESS-FIT TERMINAL AND TERMINAL PRESS-FIT STRUCTURE

(71) Applicant: Yazaki Corporation, Tokyo (JP)

(72) Inventors: Kousuke Kida, Makinohara (JP); Akihiro Tsuruta, Fujieda (JP)

(73) Assignee: Yazaki Corporation, Tokyo (JP)

( * ) Notice: Subject to any disclaimer, the term of this patent is extended or adjusted under 35 U.S.C. 154(b) by 52 days.

(21) Appl. No.: 13/972,033

(22) Filed: Aug. 21, 2013

(65) Prior Publication Data

US 2014/0065897 A1 Mar. 6, 2014

(30) Foreign Application Priority Data

Aug. 31, 2012 (JP) ..... 2012-192358

(51) Int. Cl.
*H01R 13/40* (2006.01)
*H01R 13/02* (2006.01)
*H01R 13/41* (2006.01)

(52) U.S. Cl.
CPC ..... *H01R 13/02* (2013.01); *H01R 13/40* (2013.01); *H01R 13/41* (2013.01)

(58) Field of Classification Search
CPC ..... H01R 13/40; H01R 13/02
USPC ..... 439/733.1, 78, 66, 889, 80, 84, 82, 585
See application file for complete search history.

(56) References Cited

U.S. PATENT DOCUMENTS 5,692,928 A * 12/1997 Nelson et al. ..... 439/733.1
7,448,918 B2 * 11/2008 Lappoehn ..... 439/660
7,722,413 B2 * 5/2010 Tonosaki ..... 439/751
2005/0250356 A1 * 11/2005 Matsumura et al. ..... 439/82
2005/0277341 A1 12/2005 Noguchi
2008/0124980 A1 5/2008 Lappoehn
2011/0201237 A1 * 8/2011 Suzuki et al. ..... 439/884
2013/0034976 A1 * 2/2013 Tonosaki ..... 439/84

FOREIGN PATENT DOCUMENTS

JP 2005353371 A 12/2005

OTHER PUBLICATIONS

Communication issued on May 6, 2015 by The State Intellectual Property Office of PR China in related Application No. 201310392450.5.

* cited by examiner

*Primary Examiner* — Abdullah Riyami
*Assistant Examiner* — Harshad Patel
(74) *Attorney, Agent, or Firm* — Sughrue Mion, PLLC

(57) ABSTRACT

To provide a press-fit terminal and a terminal press-fit structure that enable shortening of a press-fit portion in its longitudinal direction and miniaturization of a connector. A press-fit terminal has insertion stoppers that are projectingly provided on respective flanks of a press-fit portion and that have respective engagement surfaces oriented orthogonally to a press-fit direction; and holding projections that are projectingly provided on respective protruding leading-end faces of the insertion stoppers and that bite into interior side walls of a press-fit hole of a housing which receives the press-fit portion. Each of the holding projections is projectingly formed in a portion of the protruding leading-end face of the insertion stopper along its thicknesswise direction.

4 Claims, 5 Drawing Sheets

PRESS-FIT TERMINAL AND TERMINAL PRESS-FIT STRUCTURE

TECHNICAL FIELD

The invention relates to a press-fit terminal and a terminal press-fit structure.

BACKGROUND ART

A terminal press-fit structure that enables augmentation of strength to hold a terminal without increasing a developed length of a terminal is disclosed in Patent Document 1.

As shown in FIG. 5, the terminal press-fit structure has a plurality of barbs 505 that are projectingly formed on both side edges of a press-fit main body 503 of a terminal 501, and the barbs 505 bite into an interior wall of a press-fit hole 511 of a housing 509 that receives a press-fit portion 507 of the terminal 501, thereby fixedly press fitting the press-fit portion 507 into the housing 509. The press-fit portion 507 is formed into a flat monolayer structure, and the plurality of barbs 505 are configured such that their leading ends are situated on one side and the other side, one after the other, of a principle opposing surface of the press-fit portion 507.

In the terminal press-fit structure, the press-fit portion 507 is formed into a flat monolayer structure, and hence an exploded length of the terminal can be made smaller when compared with a case where the press-fit portion is made up of a double layer structure. Moreover, the plurality of barbs 505 are configured so as to be situated on one side and the other side, one after the other, of the principal opposing surface of the press-fit portion 507. Hence, when the barbs 505 bite into the interior wall of the press-fit hole 511, and the barbs 505 on one side and the barbs 505 on the other side bite to different depths in a thicknesswise direction of a plate. Thus, strength to hold the housing 509 can be augmented.

RELATED ART DOCUMENT

Patent Document

[Patent Document 1] JP-A-2005-353371

SUMMARY OF THE INVENTION

Problem that the Invention is to Solve

However, in the press-fit portion 507, pressure shoulders 513 (insertion stoppers) and the barbs 505 (holding projections) are molded separately from each other along a longitudinal direction of the terminal 501. Accordingly, the press-fit portion 507 becomes longer in its longitudinal direction, which poses hindrance to miniaturization of the connector.

The invention has been conceived in light of the circumstances, and an objective of the invention is to provide a press-fit terminal and a terminal press-fit structure that enable shortening of a press-fit portion in its longitudinal direction and miniaturization of a connector.

Means for Solving the Problem

The object described above is achieved by the following constitutions.

(1) A press-fit terminal comprising:

insertion stoppers that are projectingly formed on respective flanks of a press-fit portion of a terminal body and that respectively have engagement surfaces oriented orthogonally to a press-fit direction; and holding projections that are provided on respective protruding leading-end faces of the respective insertion stoppers and that bite into an interior wall of a housing which receives the press-fit portion, wherein the holding projections are provided projectingly in portions of the respective protruding leading-end faces of the insertion stoppers in a thicknesswise direction of a plate.

In the press-fit terminal having the configuration described in connection with (1), the holding projections are provided on the respective protruding leading-end faces of the insertion stoppers. Thereby, compared to a case where the holding projections and the insertion stoppers are disposed side by side in a direction in which the terminal body is to be press fitted, the press-fit portion can be shortened in its longitudinal direction. The holding projections are projectingly formed along the thicknesswise direction of the plate in only the portions of the respective protruding leading-end faces of the insertion stoppers. The remaining portions of the respective protruding leading-end faces of the insertion stoppers that are free of the holding protrusions work as holding surfaces that are to come into contact with the interior wall of the press-fit hole of the housing. To be specific, since the interior wall of the press-fit hole that opposes the holding surfaces in the respective protruding leading-end faces of the insertion stoppers will not be chipped by the holding projections during press fitting of the terminal, clearance will not occur between the interior wall and the holding surfaces in the respective protruding leading-end faces of the insertion stoppers. Therefore, the interior wall of the press-fit hole of the housing can restrict inclination of the terminal body without fail, so that the accuracy of straightness of the press-fit terminal, which is achieved after the terminal is press fitted into the housing, is enhanced. Moreover, the press-fit terminal can be molded without increasing the number of pressing steps and manufactured inexpensively.

(2) A terminal press-fit structure comprising:

insertion stoppers that are projectingly formed on respective flanks of a press-fit portion of a terminal body and that respectively have engagement surfaces oriented orthogonally to a press-fit direction; and holding projections that are provided on respective protruding leading-end faces of the respective insertion stoppers and that bite into an interior wall of a housing which receives the press-fit portion, wherein the holding projections are provided projectingly in portions of the respective protruding leading-end faces of the insertion stoppers in a thicknesswise direction of a plate; and tapered walls are formed on the press-fit hole of the housing in a press-fit direction in which the tapered walls come into contact with the respective engagement surfaces of the insertion stoppers.

In the terminal press-fit structure having the configuration described in connection with (2), when the press-fit terminal is inserted into the press-fit hole of the housing, the electric contact at a leading end of the terminal is first inserted into the press-fit hole. A width of the electric contact is smaller than a width of the insertion stoppers in a direction orthogonal to the thickness direction of the terminal plate. A contact insertion hole is formed in the housing so as to continue from a front of the press-fit hole in the press-fit direction. A width of the contact insertion hole is smaller than the press-fit hole in a direction orthogonal to the thicknesswise direction of the terminal plate. When the electric contact enters the contact insertion hole after passing through the press-fit hole, the thus-inserted press-fit terminal experiences, in connection with a direction of insertion, restriction imposed by the tapered walls formed at a border between the press-fit hole and the contact insertion hole, thereby being guided and smoothly inserted into the contact insertion hole. When the press-fit terminal whose electric contact remains inserted into the contact insertion hole is further inserted, the holding projections bite into the interior wall, whereupon press fitting is initiated. Press fitting progresses further, and the engagement surfaces of the respective insertion stoppers reach and come into contact with the tapered walls, whereby further insertion of the terminal is restricted, press fitting is thus completed. In a state when press fitting is completed, the remaining portions of the respective protruding leading-end faces of the insertion stoppers that are free of the holding projections work as holding surfaces that are to come into contact the interior wall of the press-fit hole of the housing. To be specific, since the interior side of the press-fit hole that opposes the holding surfaces in the respective protruding leading-end faces of the insertion stoppers will not be chipped by the holding projections during press fitting of the terminal, clearance will not occur between the holding surfaces in the respective protruding leading-end faces of the insertion stoppers and the interior wall. Accordingly, the interior wall of the press-fit hole of the housing can restrict inclination of the terminal body without fail, thereby preventing inclination, which would otherwise arise when the engagement surfaces of the respective insertion stoppers come into contact with the respective tapered walls. Consequently, the tapered walls eliminate a possibility of deterioration of accuracy of straightness of the press-fit terminal after the terminal is press fitted into the housing.

Advantages of the Invention

The press-fit terminal of the invention enables shortening of the press-fit portion in its longitudinal direction, so that a connector can be miniaturized. In addition, accuracy of straightness of the press-fit terminal, which is achieved after the terminal is press fitted into the housing, can also be enhanced.

The terminal press-fit structure of the invention enables shortening of the press-fit portion in its longitudinal direction and enhances easiness of insertion of the terminal into the press-fit hole of the housing by means of press fitting.

The invention has been briefly described thus far. Details of the invention will become more clarified by reading through a mode for implementing the invention (hereinafter called an "embodiment), which will be described below, by reference to the accompanying drawings.

BRIEF DESCRIPTION OF THE DRAWINGS

FIG. 5 shows a related-art terminal press-fit structure, wherein

MODE FOR IMPLEMENTING THE INVENTION

An embodiment of the invention is hereunder described by reference to the accompanying drawings.

Figure 1:
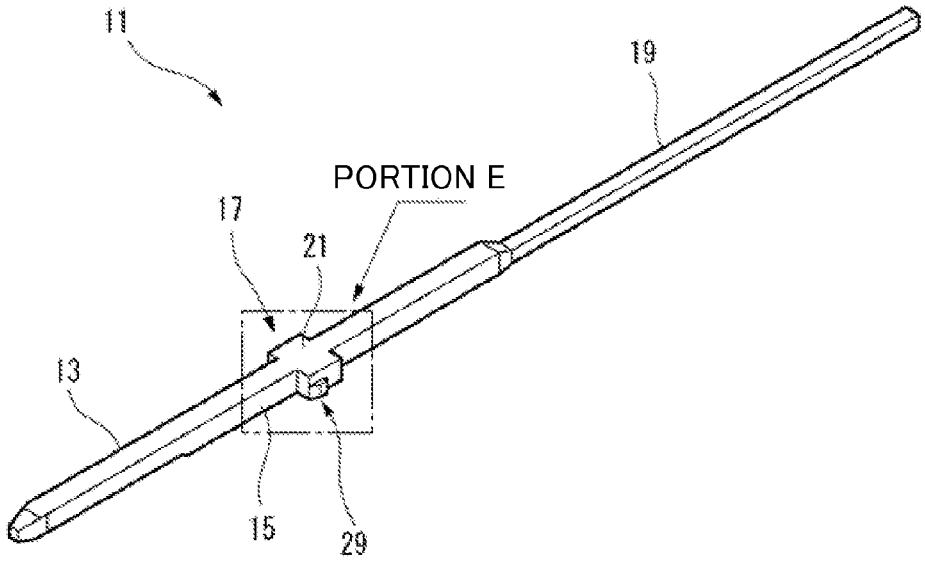
FIG. 1 is a perspective view showing a press-fit terminal of an embodiment of the invention.

As shown in FIG. 1, a press-fit terminal 11 of the embodiment has at its leading end a male tab 13 that is an electric contact. The male tab 13 is continually followed in sequence from the male tab 13 by a terminal body 15, insertion stoppers 17, and a lead 19. The press-fit terminal 11 is formed in one by punching a raw metal plate by means of thin plate working.

A press-fit portion 21 having an increasing width in a direction orthogonal to a thicknesswise direction of a terminal plate is formed at a middle of the terminal body 15 in its longitudinal direction. The press-fit portion 21 has the insertion stoppers 17 that are projectingly provided on respective flanks 23 of the press-fit portion 21 shown in FIG. 2 and that respective have engagement surfaces 25 oriented orthogonal to a press-fit direction. To be specific, the insertion stoppers 17 are formed such that both flanks 23 of the press-fit portion 21 protrude like two wings.

Holding projections 29 are projectingly provided on respective protruding leading-end faces 27 on both sides of the insertion stoppers 17. Each of the holding projections 29 is projectingly formed at the protruding leading-end face 27 of the insertion stopper 17 in a portion with respect to the thicknesswise direction of the plate (i.e., the vertical direction in FIG. 2).

Figure 2:
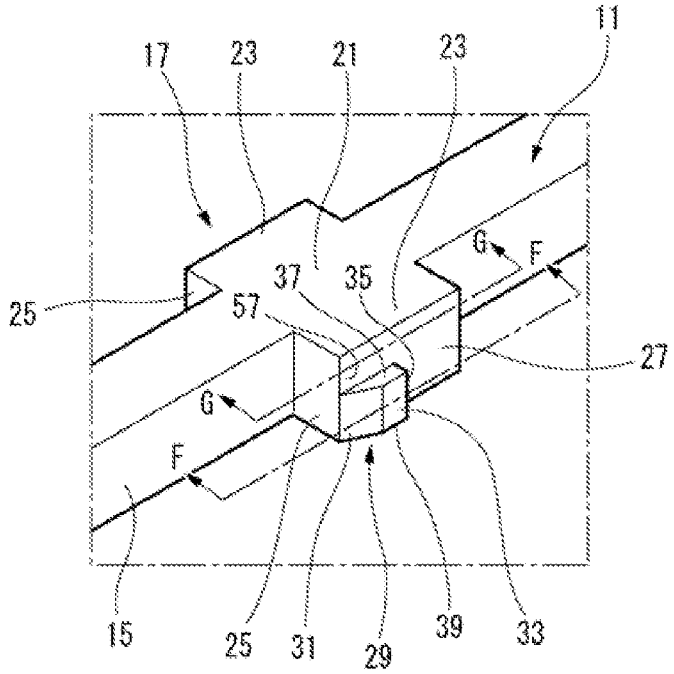
FIG. 2 is an enlarged view of portion E of FIG. 1.

In other words, each of the holding projections 29 is projectingly formed at the protruding leading-end face 27 of the insertion stopper 17 partially in the thicknesswise direction of the plate (i.e., the vertical direction in FIG. 2).

In this embodiment, each of the holding projections 29 is formed in a size that is substantially half of the plate thickness. In addition, each of the holding projections 29 may also be formed in a size that is about two-thirds to three-fourths of the plate thickness. In other words, each holding projection 29 is formed on the protruding leading-end face 27 such that a remaining portion which is free of the holding projection 29 is left on the protruding leading-end face 27 in the thicknesswise direction of the plate.

The protruding leading-end faces 27 on both sides of the insertion stopper 17 are formed from flat surfaces that are parallel to each other in the terminal press-fit direction. Each of the holding projections 29 has a slope 31 that has an increasing elevation with reference to the protruding leading-end face 27 toward the rear in the press-fit direction, a parallel surface 33 that is connected to a rear of the slope 31 in the press-fit direction and parallel to the protruding leading-end face 27, and a retaining surface 35 that is connected to a rear of the parallel surface 33 in the press-fit direction, to thus also be connected to the protruding leading-end face 27 substantially at a right angle with respect to the parallel surface 33. Specifically, the holding projections 29 are formed substantially in the form of a wedge.

Upper and lower surfaces of each of the holding projections 29 are made up of a projection upper surface 37 and a projection lower surface 39 that are parallel to front and back sides of the raw metal plate. As above, each of the holding projections 29 is projectingly formed in a portion of the protruding leading-end face 27 in the thicknesswise direction of the plate. In the embodiment, the projection upper surface 37 is situated lower than a surface of the raw metal plate in a smaller thicknesswise direction, to thus be formed projectingly in a portion with respect to the thicknesswise direction. A proposed machining method for forming the projection upper surface 37 as being dented with reference to the surface of the raw metal surface includes a method for making thin the holding projections 29 originally formed in the same thickness as that of the raw metal plate by means of pressing, cutting, abrasion, and so forth.

Figure 3A:
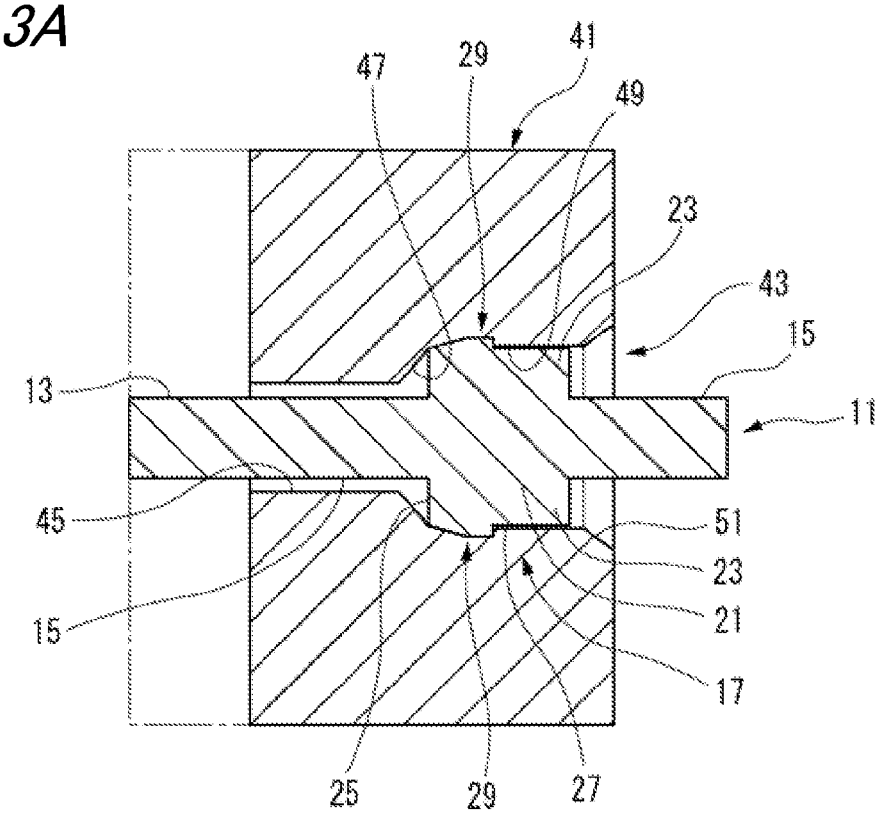
FIG. 3A is a cross sectional view of the press-fit terminal press fitted into a housing taken along line F-F shown in FIG. 2.
Figure 3B:
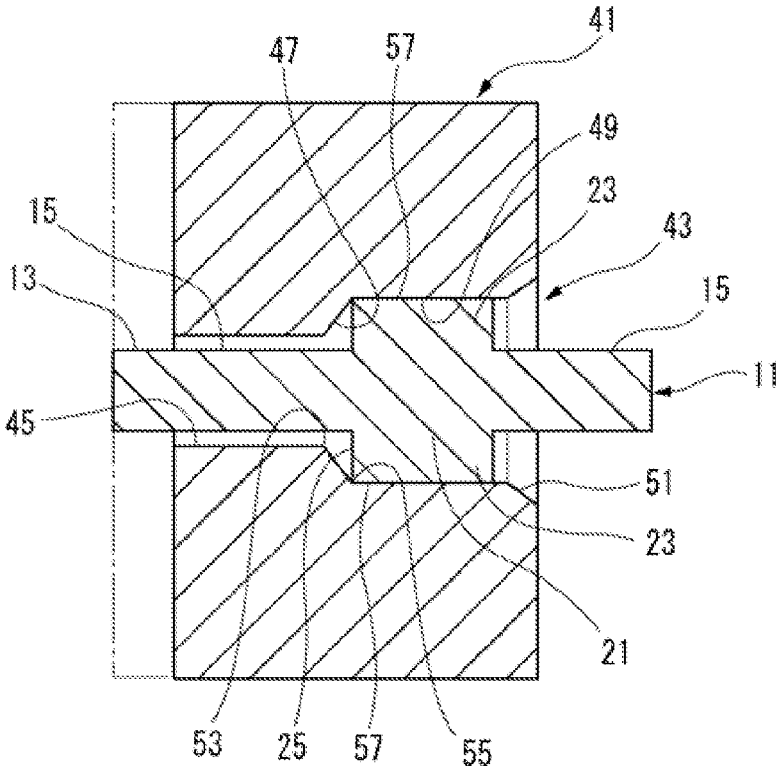
FIG. 3B is a cross sectional view of the press-fit terminal press fitted into the housing taken along line G-G shown in FIG. 2.

As shown in FIGS. 3A and 3B, the press-fit terminal 11 is inserted into a housing 41 of the connector. The housing 41 is molded from a synthetic resin. A press-fit hole 43 for receiving the holding projections 29 of the press-fit portion 21 is formed in the housing 41. The press-fit hole 43 is connected to a contact insertion hole 45 that enables insertion of the male tab 13. The press-fit hole 43 is created by means of sequencing, along the press-fit direction, tapered walls 47, interior side walls (an interior wall) 49, and chamfered portions 51 so as to continue from the rear of the contact insertion hole 45.

The pair of interior side walls 49 are formed parallel to each other so as to leave a separation dimension that substantially matches or are slightly smaller than a dimension of spacing between the protruding leading-end faces 27 on both sides of the insertion stoppers 17. Specifically, the press-fit terminal 11 to be press fitted into the press-fit hole 43 is configured in such a way that the holding projections 29 of the press-fit portion 21 bite into the interior side walls 49 of the press-fit hole 43.

In the terminal press-fit structure of the embodiment in which the press-fit terminal 11 is press fitted into the press-fit hole 43 of the housing 41, the tapered walls 47 are formed on the press-fit hole 43 of the housing 41. The tapered walls 47 are formed so as to become narrower in the press-fit direction, and contact the respective engagement surfaces 25 of the insertion stoppers 17. Namely, in each of the tapered walls 47, a front-side narrower portion 53 is connected to the contact insertion hole 45, and a rear-side wider portion 55 is connected to the interior side wall 49.

Operation of the press-fit terminal 11 and the terminal press-fit structure that have the aforementioned configurations is now described.

In the press-fit terminal 11 of the embodiment, the holding projections 29 are provided on the respective protruding leading-end faces 27 of the insertion stoppers 17. Compared to a case where the holding projections 29 and the insertion stoppers 17 are disposed side by side along the press-fit direction of the terminal body 15, the press-fit portion 21 can be shortened in its longitudinal direction. Each of the holding projections 29 is projectingly provided in only one portion of the protruding leading-end face 27 of the insertion stopper 17 in the thicknesswise direction of the plate. The other portion of the protruding leading-end face 27 of each insertion stopper 17 that is free of the holding projection 29 works as a holding surface 57 (see FIG. 2) that is to contact the interior side wall 49 of the press-fit hole 43 of the housing 41. To be specific, the interior side walls 49 of the press-fit hole 43 that oppose the respective holding surfaces 57 of the respective protruding leading-end faces 27 of the insertion stoppers 17 will not be chipped by the holding projections 29 during press fitting of the terminal. Accordingly, the interior side walls 49 of the press-fit hole 43 of the housing 41 can restrict inclination of the terminal body 15 without fail, so that the accuracy of straightness of the press-fit terminal 11, which is achieved after being press fitted into the housing, is enhanced. Moreover, the press-fit terminal 11 can be molded without increasing the number of pressing steps, so that it can be inexpensively manufactured.

In the terminal press-fit structure of the embodiment, when the press-fit terminal 11 is inserted into the press-fit hole 43 of the housing 41, the male tab 13 at the leading end of the terminal is first inserted into the press-fit hole 43. A width of the male tab 13 is smaller than the width of the insertion stoppers 17 in a direction orthogonal to the thicknesswise direction of the terminal plate. The contact insertion hole 45 is formed so as to continue from the front of the press-fit hole 43 in the housing 41 in the press-fit direction. A width of the contact insertion hole 45 is smaller than the width of the press-fit hole 43 in the direction orthogonal to the thicknesswise direction of the terminal plate. After the male tab 13 has passed through the press-fit hole 43, the inserted press-fit terminal 11 experiences, with respect to the direction of insertion, restriction imposed by the tapered walls 47 formed at a border between the press-fit hole 43 and the contact insertion hole 45 when entering the contact insertion hole 45, thereby being guided and smoothly inserted into the contact insertion hole 45.

When the press-fit terminal 11 whose male tab 13 remains inserted into the contact insertion hole 45 is inserted further, the holding projections 29 bite into the interior side walls 49, whereupon press fitting of the press-fit terminal is initiated. Press fitting progresses further, and the engagement surfaces 25 of the respective insertion stoppers 17 reach and come into contact with the tapered walls 47, whereby further insertion of the terminal is restricted, press fitting is thus completed.

In a state when press fitting is completed, the remaining portions of the respective protruding leading-end faces 27 of the insertion stoppers 17 that are free of the holding projections 29 work as the holding surfaces 57 that are to come into contact the interior wall of the press-fit hole of the housing. To be specific, since the interior side wall of the press-fit hole 43 that oppose the holding surfaces 57 in the respective protruding leading-end faces 27 of the insertion stoppers 17 will not be chipped by the holding projections 29 during press fitting of the terminal, clearance will not occur between the holding surfaces 57 in the respective protruding leading-end faces 27 of the insertion stoppers 17 and the interior side walls 49. Accordingly, the interior walls 49 of the press-fit hole 43 of the housing 41 can restrict inclination of the terminal body 15 without fail, thereby preventing inclination, which would otherwise arise when the engagement surfaces 25 of the respective insertion stoppers 17 come into contact with the respective tapered walls 47. Consequently, the tapered walls 47 eliminate a possibility that accuracy of straightness of the press-fit terminal 11 deteriorates, which would occur after the terminal is press fitted into the housing.

Figure 4:
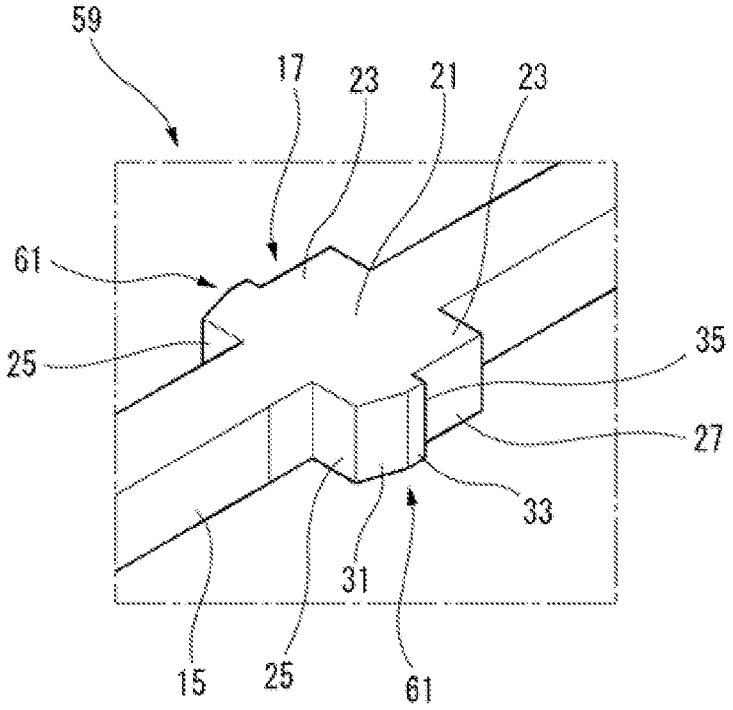
FIG. 4 is an enlarged view of a principle section of the press-fit terminal of a comparative terminal.
Figure 5A:
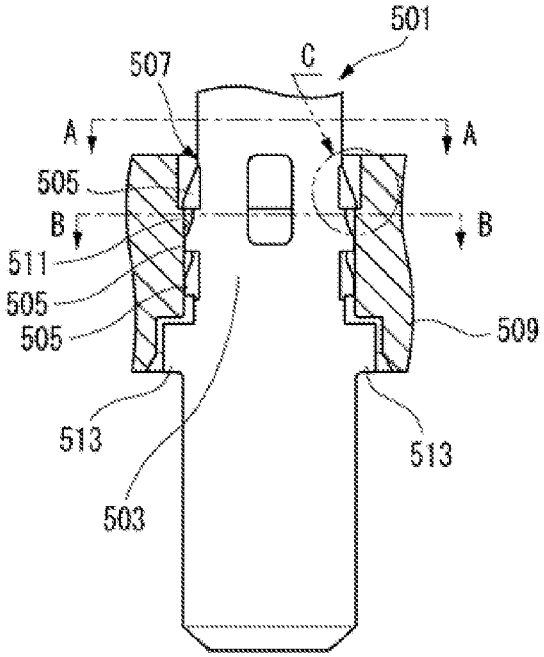
FIG. 5A is a partial, cross sectional plan view.
Figure 5B:
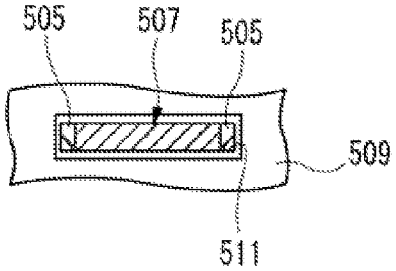
FIG. 5B is a cross sectional view taken along line A-A shown in FIG. 5A.
Figure 5C:
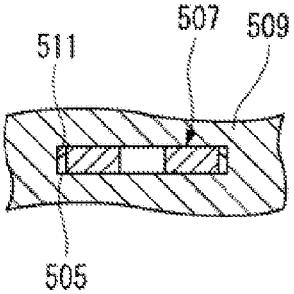
FIG. 5C is a cross sectional view taken along line B-B shown in FIG. 5A.
Figure 5D:
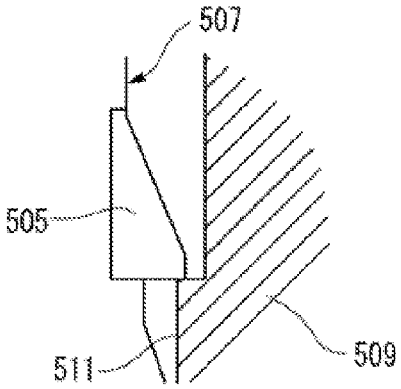
FIG. 5D is an enlarged view of an area designated by arrow C shown FIG. 5A.

A press-fit terminal 59 described in connection with a comparative example shown in FIG. 4 can be mentioned as a counterpart of the foregoing press-fit terminal 11. The press-fit terminal 59 described in connection with the comparative example has the insertion stoppers 17 that are projectingly provided on the respective flanks 23 of the press-fit portion 21 in the terminal body 15 and that have the respective engagement surfaces 25 oriented orthogonally to the press-fit direction; and holding projections 61 that are provided on the respective protruding leading-end faces 27 of the insertion stoppers 17 and that bite into the interior sidewalls 49 of the press-fit hole 43 of the housing 41 that receives the press-fit portion 21.

In the press-fit terminal 59, each of the holding projections 61 is formed projectingly from one end to the other end of the entire protruding leading-end face 27 of the insertion stopper 17 in the thicknesswise direction of the plate. Therefore, although an advantage of shortening the entire length of the press-fit portion is yielded, the holding projections 61 might chip all of the interior side walls 49 during press fitting.

As a consequence, the holding surfaces 57 (see FIG. 2) that come into contact with the interior side walls 49 of the press-fit hole 43 of the housing 41, such as those formed in the press-fit terminal 11 of the embodiment, are not formed on the press-fit terminal 59 of the comparative example, and hence clearance between the protruding leading-end faces 27 of the insertion stoppers 17 and the interior side walls 49 of the press-fit hole 43 may become greater by chipping. Inclination of the press-fit terminal 59 therefore cannot be restricted, which poses hindrance to expecting enhanced accuracy of straightness after press fitting of the terminal.

Accordingly, the press-fit terminal 11 of the embodiment enables shortening of the press-fit portion 21 in its longitudinal direction, so that the connector can be miniaturized. In addition, the accuracy of straightness of the press-fit terminal 11, which is achieved after the terminal is press fitted into the housing, can be enhanced.

In the terminal press-fit structure of the embodiment, the press-fit portion 21 can be shortened in its longitudinal direction, and the connector can be miniaturized. Further, ease of insertion of the press-fit terminal 11 into the press-fit hole 43 of the housing 41 can be enhanced.

The invention is not limited to the embodiment and susceptible to modifications, improvements, and the like, as necessary. Furthermore, materials, shapes, dimensions, quantities, layouts, and others, of the respective constituent elements described in connection with the embodiment are arbitrary and unrestricted, so long as the invention is accomplished.

The present application is based on Japanese Patent Application No. 2012-192358 filed on Aug. 31, 2012, the entire content of which is incorporated by reference herein.

DESCRIPTIONS OF THE REFERENCE NUMERALS AND SYMBOLS

11 . . . PRESS-FIT TERMINAL
13 . . . MALE TAB (ELECTRIC CONTACT)
15 . . . TERMINAL BODY
17 . . . INSERTION STOPPER
19 . . . LEAD
21 . . . PRESS-FIT PORTION
23 . . . FLANKS
25 . . . ENGAGEMENT SURFACE
27 . . . PROTRUDING LEADING-END FACE
29 . . . HOLDING PROJECTION
41 . . . HOUSING
43 . . . PRESS-FIT HOLE
47 . . . TAPERED WALL
49 . . . INTERIOR SIDE WALLS (INTERIOR WALL)

The invention claimed is:

1. A press-fit terminal comprising:

insertion stoppers that are projectingly formed on respective flanks of a press-fit portion of a terminal body and that respectively have engagement surfaces oriented orthogonally to a press-fit direction; and holding projections that are provided on associated protruding leading-end faces of the associated insertion stoppers and that bite into an interior wall of a housing which receives the press-fit portion, wherein each of the holding projections is provided projectingly in a direction perpendicular to a thickness direction of the terminal body or the holding projection in only a portion of the associated protruding leading-end faces in the thickness direction of the terminal body such that a thickness of the each of the holding projections in the thickness direction is smaller than a thickness of the associated leading-end faces in the thickness direction.

2. The press-fit terminal according to claim 1, further comprising holding surfaces provided in each portion of the protruding leading-end faces which are free of the holding projections.

3. A terminal press-fit structure comprising:

insertion stoppers that are projectingly formed on respective flanks of a press-fit portion of a terminal body and that respectively have engagement surfaces oriented orthogonally to a press-fit direction; and holding projections that are provided on associated protruding leading-end faces of the associated insertion stoppers and that bite into an interior wall of a housing which receives the press-fit portion, wherein each of the holding projections is provided projectingly in a direction perpendicular to a thickness direction of the terminal body or the holding projection in only a portion of the associated protruding leading-end faces in the thickness direction of the terminal body such that a thickness of the each of the holding projections in the thickness direction is smaller than a thickness of the associated leading-end faces in the thickness direction; and tapered walls are formed on the press-fit hole of the housing in a press-fit direction in which the tapered walls come into contact with the respective engagement surfaces of the insertion stoppers.

4. The terminal press-fit structure according to claim 3, further comprising holding surfaces provided in each portion of the protruding leading-end faces which are free of the holding projections.

* * * * *